US005735139A

United States Patent [19]

Lord et al.

[11] Patent Number: 5,735,139

[45] Date of Patent: Apr. 7, 1998

[54] DUAL INLET OIL SEPARATOR FOR A CHILLER

[75] Inventors: Richard G. Lord, Tullahoma, Tenn.; Kenneth J. Nieva, Baldwinsville, N.Y.

[73] Assignee: Carrier Corporation, Syracuse, N.Y.

[21] Appl. No.: 673,375

[22] Filed: Jun. 28, 1996

[51] Int. Cl.[6] ..... F25B 43/02

[52] U.S. Cl. ..... 62/470; 62/510

[58] Field of Search ..... 62/470, 471, 472, 62/473, 510, 84

[56] References Cited

U.S. PATENT DOCUMENTS

| | | | |
|---|---|---|---|
| 2,190,138 | 2/1940 | Smith et al. | 62/473 X |
| 3,633,377 | 1/1972 | Quick | 62/470 X |
| 5,029,448 | 7/1991 | Carey | 62/470 X |

*Primary Examiner*—Harry B. Tanner

[57] ABSTRACT

An oil separator for a refrigeration system having two inlets for receiving two streams of a mixture of oil and refrigerant for separation. One inlet is on each side of the oil separator. This allows for a separator with a smaller diameter to be used to achieve the same preferred speed of travel of the oil-refrigerant mixture.

7 Claims, 3 Drawing Sheets

DUAL INLET OIL SEPARATOR FOR A CHILLER

BACKGROUND OF THE INVENTION

1. Field of the Invention

This invention relates in general to refrigeration systems and, in particular, to oil separators for chiller type refrigeration systems.

2. Discussion of the Invention Background

Chiller type refrigeration systems typically include a screw compressor, an oil-refrigerant separator, a condenser, an economizer including an expansion valve and an evaporator or cooler. These components are connected to each other by tubing that carries the refrigerant through the system. The evaporator typically includes a plurality of tubes that circulate water in a closed loop to another heat exchanger or cooling coil. At the cooling coil, circulating room air is induced through the cooling coil by a fan so that heat is removed from the circulating room air. The screw compressor is lubricated by oil mixed with the refrigerant. The combined oil and refrigerant mixture is carried through the compression cycle and then discharged into the oil separator where the oil is removed from the refrigerant. From the oil separator, the refrigerant flows to the condenser.

In the past, oil separators had a single inlet for receiving the refrigerant from one or more compressors on a circuit. This required an oil separator of larger diameter than was necessary, leading to relatively higher manufacturing costs than was necessary.

SUMMARY OF THE INVENTION

Oil separators for chillers are generally of two types, vertical or horizontal. Horizontal oil separators are usually cylindrical with an inlet at one end. In a horizontal separator, the combined oil and refrigerant mix enters through the inlet. The mixture is discharged onto the end of the oil separator which causes some of the oil to separate from the refrigerant. The mixture then moves at a slow speed, preferably about 1 to 4 ft/sec. through the separator. At this speed, additional oil separates from the refrigerant due to gravity. In the last phase of separation, the mixture passes through mesh eliminators which removes all but 500 ppm of oil from the refrigerant. The refrigerant then exits from the top of the oil separator and the oil drains from the bottom.

In the past, the oil refrigerant mixture from two compressors on a circuit would enter the oil separator at a single inlet. The inventors have discovered that if two inlets are provided, one at each end of the oil separator, a separator with a smaller diameter can be used to achieve the same preferred speed of travel of the oil-refrigerant mixture. The single inlet separator diameter would have to be 1.4 times larger in diameter than the dual inlet separator diameter to achieve the same speed of travel of the mixture. Although, the single inlet separator would be 30 percent shorter than the dual inlet vessel, a longer vessel of smaller diameter reduces manufacturing costs.

BRIEF DESCRIPTION OF THE DRAWINGS

For a better understanding of the present invention, reference will be made to the following detailed description of the invention which is to be read in conjunction with the accompanying drawings, wherein.

DETAILED DESCRIPTION OF A PREFERRED EMBODIMENT

Figure 1:
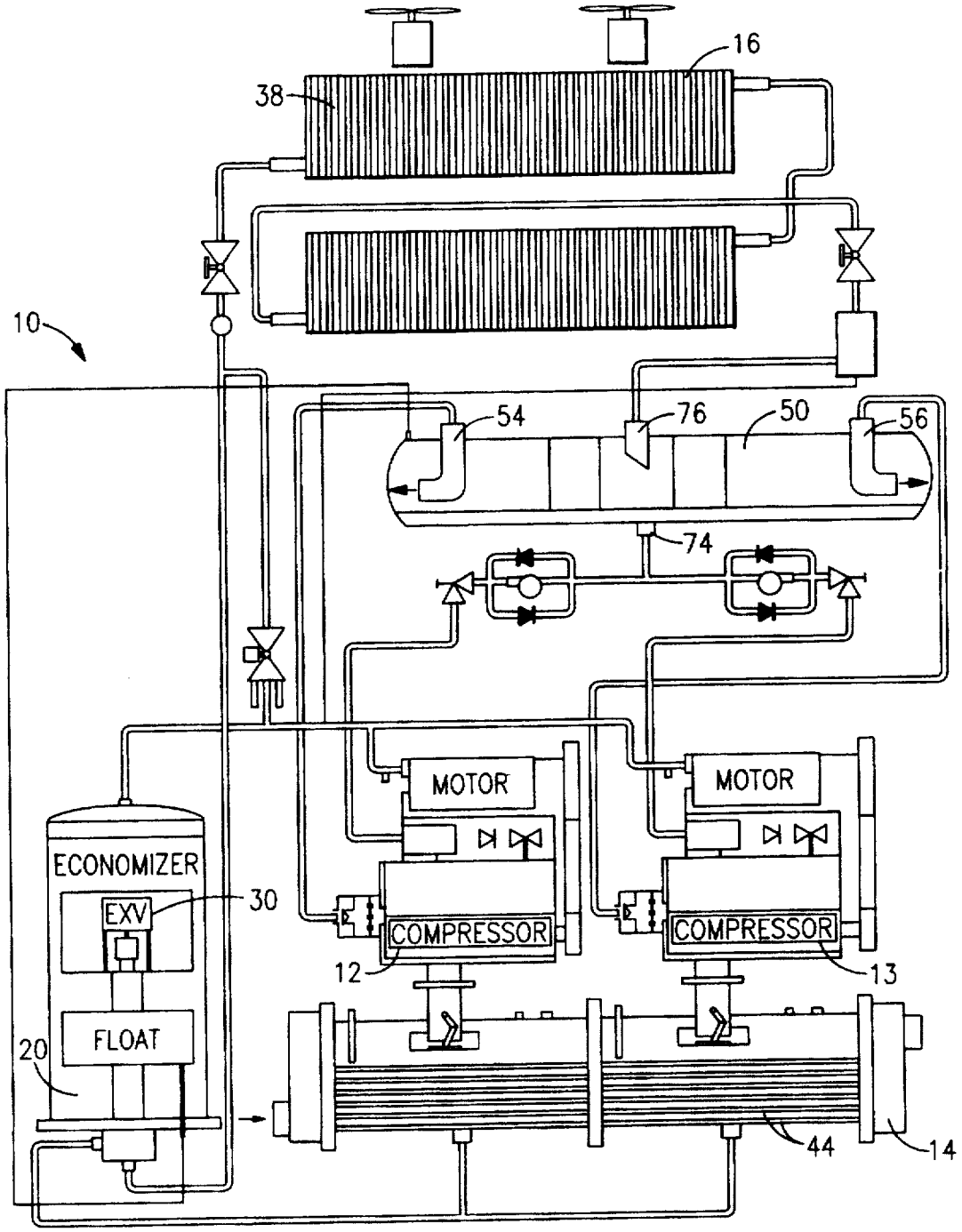
FIG. 1 is an illustration of a chiller employing the separator of the present invention.

Referring now to the drawings and initially to FIG. 1 there is shown a chiller 10 in accordance with the present invention. The chiller 10 includes two screw compressors 12 and 13, an evaporator or cooler 14, a condenser 16, an economizer 20 with an expansion valve 30, and an oil-refrigerant separator 50.

The operation of the chiller 10 will be briefly described with reference to FIG. 1. The liquid exiting the condenser 16 is relatively warm. It cools down as a result of passing through the expansion valve 30 before entering the evaporator 14. The pressure drop across this valve 30 causes some of the condensed liquid refrigerant to change to a gaseous phase, which in turn, cools down the rest of the liquid. The liquid refrigerant then comes in contact with the water tubes 44 which are carrying warm water. The heat from the warm water passing through the water tubes 44 is absorbed into the liquid refrigerant which then vaporizes or evaporates while increasing in temperature. The refrigerant which is now in a vapor state, is induced into the compressors 12 and 13. In the compressors 12 and 13, the vaporized refrigerant is then increased in pressure and temperature as a result of the compression experienced therein. The compressors then discharge the refrigerant into the oil separator 50 which is described in detail below. From the oil separator 50, the refrigerant travels to the condenser 16 where the refrigerant cools down and liquifies as heat is transferred to colder air through cooling coils. The condenser 16 includes fins 38. Air flowing across the condenser fins absorbs heat from the compressed refrigerant which causes the refrigerant to condense. The refrigeration system schematically illustrated herein, in actual practice, may desirably comprise a selectable plurality of compressors and/or compressor stages and a selectable plurality of condensers and/or condenser stages. The present invention is applicable to a variety of system configurations.

Figure 2:
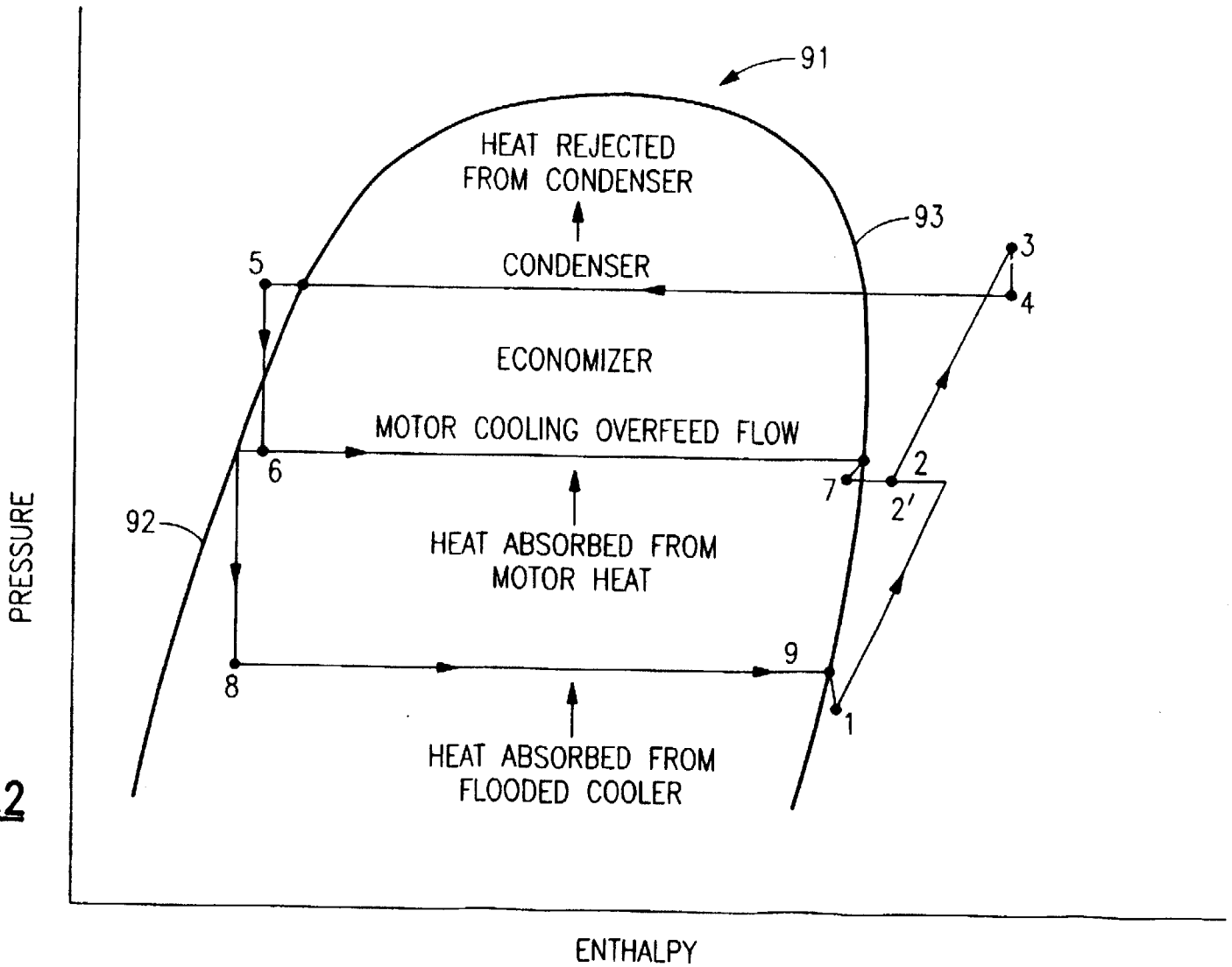
FIG. 2 is an illustration showing the phases of the refrigerant in the system.

The thermodynamic cycle of the present chiller system will be explained with reference to FIG. 2 which shows the phase changes in the refrigerant as it moves through the refrigeration loop. The refrigerant saturation curve 91 is shown wherein pressure is plotted against enthalpy. The liquid line 92 is depicted on the left hand side of the curve while the vapor line 93 is on the right hand side of the curve. Initially, saturated vapor enters the suction side of the compressors 12 and 13 from the evaporator at state point 1 and is compressed adiabatically to a higher pressure shown at state point. Vapor from the economizer 20 is introduced into the compressors 12 and 13 at state point 7 where it is mixed with the in-process vapor causing a rebalance of the refrigerant enthalpy to state point 2. The compressors 12 and 13 continue to produce work on the combined vapor until the vapor reaches discharge pressure at state point 3.

The compressed vapor enters the oil separator 50 at state point 3 wherein the oil is removed from the refrigerant and returned to the compressors 12 and 13. Due to the oil separation procedure, the pressure of the refrigerant vapor drops slightly to state point 4 at the entrance to the condenser 16.

To obtain good performance from the screw compressor requires 20 to 30% by weight oil to be injected in the refrigerant. To obtain good performance from the heat exchangers, the oil must be removed to a level of about 500 ppm or less.

In the condenser 16, the refrigerant is reduced from a superheated vapor to a liquid at state point 5 and the heat of condensation is rejected into the air passing through the condenser coils. Liquid refrigerant enters the economizer 20 at state point 5 and undergoes a first adiabatic expansion to state point 6 as it passes through the expansion valve 30. As a result, some of the refrigerant is vaporized and returned to the compressors 12 and 13 through the compressor motors where it provides some motor cooling. The flash gas enters the compressors 12 and 13 at state point 7 where it mixes with the in process vapor at state point 2.

The remaining liquid in the economizer 20 is throttled through float controlled throttling orifices and is delivered to the entrance of the evaporator 14 at state point 8. Here the subcooled liquid absorbs heat from the liquid being chilled and is reduced to a vapor at state point 9. The refrigerant vapor at state point 9 is exposed to the suction side of the compressors 12 and 13 to complete the cycle.

In order for the screw compressors 12 and 13 to function properly, the compressors must be lubricated with oil. The oil mixes with the refrigerant gas entering the rotors of the screw compressors 12 and 13. The oil mixed with refrigerant is then carried through the compression cycle within the screw compressors 12 and 13. Before the heated and pressurized oil-refrigerant mixture can be introduced into the condenser 16, it is passed through the separator 50, where the oil is removed and returned to the compressors 12 and 13. The refrigerant is then moved from the separator 50 into the condenser 16 and the refrigeration cycle is repeated.

Figure 3:
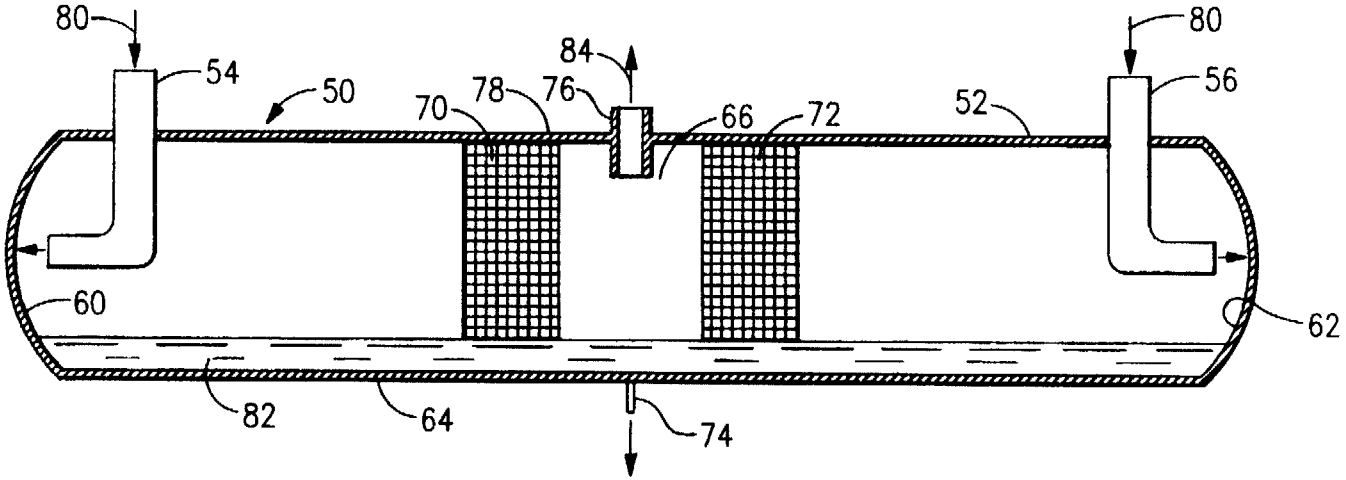
FIG. 3. is cross-sectional view of the oil separator of the present invention.
Figure 4:
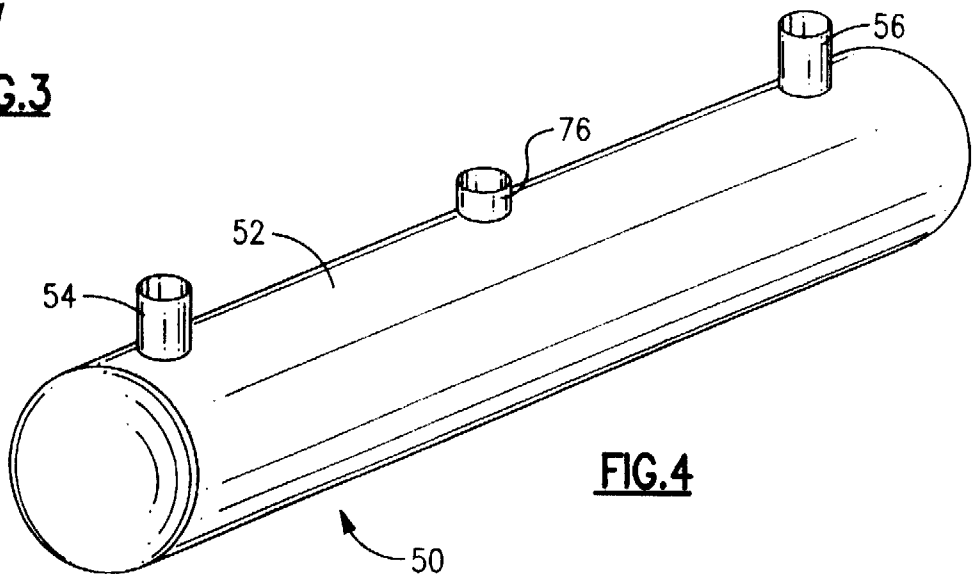
FIG. 4 is a perspective view of the oil separator of the present invention.

In FIG. 3, the oil separator 50 is shown. Preferably, the oil separator 50 has a cylindrical housing 52 although other configurations are possible. The oil separator 50 has a first inlet 54 and a second inlet 56 for receiving the mixture of oil and refrigerant represented by the arrows 80 from the compressors 12 and 13. The mixture 80 flows through the inlets 54 and 56 and is discharged into the separator walls 60 and 62. The mixture 80 from inlet 54 is discharged into wall 60 and the mixture from inlet 56 is discharged into wall 62. The force of the impact between the mixture and the walls 60 and 62 causes some of the oil 82 to separate from the mixture 80. The oil 82 flows down walls 60 and 62 and settles on the bottom 64 of the separator 50. The mixture 80 continues to flow through the separator 50 toward the center 66. As this occurs, gravity causes some additional oil 82 to separate out of the mixture. This oil 82 also settles to the bottom 64 of the separator 50.

The mixture 80 then flows through mesh eliminators 70 and 72 which remove additional oil 82 from the mixture 80. The oil 82 flows out of the separator 50 through outlet 74 in the bottom 64 of the separator 50. The refrigerant represented by the arrow 84 flows out of the outlet 76 in the top 78 of the separator 50. The oil 82 returns to the compressors 12 and 13 and the refrigerant 84 flows to the condensor and the cycle is repeated.

While this invention has been described in detail with reference to a certain preferred embodiment, it should be appreciated that the present invention is not limited to that precise embodiment. Rather, in view of the present disclosure which describes the best mode for practicing the invention, many modifications and variations would present themselves to those of skill in the art without departing from the scope and spirit of this invention, as defined in the following claims.

What is claimed is:

1. An oil separator for separating oil from refrigerant in a chiller, comprising:

a horizontally disposed, elongate housing;

a first inlet into said housing for receiving a first stream of a mixture of oil and refrigerant;

a second inlet into said housing for receiving a second stream of a mixture of oil and refrigerant;

means for separating said oil from said refrigerant in said first and second streams including means for causing said mixture to flow horizontally within said housing while allowing the oil to separate from the refrigerant by gravity;

an oil outlet for removing said oil from said housing; and a refrigerant outlet for removing said refrigerant from said housing.

2. The oil separator of claim 1 wherein said first and second inlets are disposed at opposite ends of the separator.

3. The oil separator of claim 2 wherein said housing is substantially cylindrical.

4. The oil separator of claim 1 wherein said means for separating said oil from said refrigerant includes a first mesh eliminator located between said first inlet and said refrigerant outlet and a second mesh eliminator located between said second inlet and said refrigerant outlet.

5. An oil separator as set forth in claim 1 wherein said means for separating includes separator walls formed in said housing and further wherein said inlets are so positioned as to direct the flow towards said respective separator walls to cause the mixture to impinge on said separator walls.

6. A refrigeration system comprising:

a condenser for condensing refrigerant vapor;

an evaporator for evaporating liquid refrigerant to provide cooling;

an oil separator for separating a mixture of refrigerant and oil;

a plurality of compressors for compressing refrigerant vapor received from said evaporator and for passing the compressed refrigerant vapor to said oil separator, said compressors lubricated with oil such that said refrigerant vapor passed to said oil separator contains oil, said oil separator having a horizontally disposed, elongate housing, a first inlet into said housing for receiving a first stream of said oil and refrigerant, a second inlet into said housing for receiving a second stream of said oil and refrigerant, means for separating said oil from said refrigerant in said first and second streams including means for causing said mixture to flow horizontally within said housing while allowing the oil to separate from the refrigerant by gravity, an oil outlet for removing said oil from said housing, and a refrigerant outlet for removing said refrigerant from said housing.

7. A refrigeration system as set forth in claim 5 wherein said means for separating includes separator walls formed in said housing and further wherein said first and second inlets are so disposed as to direct the flow toward said respective separator walls to cause the mixture to impinge on said separator walls.

* * * * *